US007234448B2

(12) United States Patent
Hanyu

(10) Patent No.: US 7,234,448 B2
(45) Date of Patent: Jun. 26, 2007

(54) FUEL INJECTION PUMP HAVING FILTER

(75) Inventor: Toshiharu Hanyu, Obu (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 10/909,306

(22) Filed: Aug. 3, 2004

(65) Prior Publication Data

US 2005/0047929 A1 Mar. 3, 2005

(30) Foreign Application Priority Data

Sep. 3, 2003 (JP) ..... 2003-311779
May 25, 2004 (JP) ..... 2004-155029

(51) Int. Cl.
*F02M 37/04* (2006.01)

(52) U.S. Cl. ..... 123/450

(58) Field of Classification Search ..... 123/446–447, 123/450, 451, 452
See application file for complete search history.

(56) References Cited

U.S. PATENT DOCUMENTS 6,053,712 A 4/2000 Konishi et al.
6,190,139 B1 2/2001 Isozumi et al.
6,289,875 B1 9/2001 Shinohara et al.
6,293,296 B1 * 9/2001 Konishi et al. ..... 137/115.13
6,311,725 B1 * 11/2001 Hamada et al. ..... 137/565.13
6,887,388 B2 * 5/2005 Winn et al. ..... 210/739

FOREIGN PATENT DOCUMENTS

| | | |
|---|---|---|
| DE | 199 13 774 | 10/2000 |
| JP | 2002-89411 | 3/2002 |
| JP | 2002-250459 | 9/2002 |
| JP | 2002-364480 | 12/2002 |

OTHER PUBLICATIONS

EPO Examination Report dated Mar. 21, 2006.
Chinese Office Action dated Nov. 3, 2006 with translation.
EPO Examination Report dated Nov. 27, 2006.

* cited by examiner

*Primary Examiner*—Thomas Moulis
(74) *Attorney, Agent, or Firm*—Nixon & Vanderhye PC

(57) ABSTRACT

A fuel injection pump includes a cam rotating with a camshaft, a cam ring revolving around the camshaft, a housing, plungers for pressurizing and pressure-feeding fuel drawn into fuel pressurizing chambers, and a rotary pump for supplying the fuel to the fuel pressurizing chambers. The housing includes a first housing portion for rotatably housing the rotary pump and second housing portions for housing the plungers so that the plungers can reciprocate. A filter is disposed in one of an outlet portion of a first low-pressure fuel passage in the first housing streaming the fuel from the rotary pump toward the fuel pressurizing chamber, an inlet portion of a second low-pressure fuel passage of the second housing portion facing the outlet portion, and a certain point in the second low-pressure fuel passage.

20 Claims, 7 Drawing Sheets

FUEL INJECTION PUMP HAVING FILTER

CROSS REFERENCE TO RELATED APPLICATION

This application is based on and incorporates herein by reference Japanese Patent Applications No. 2003-311779 filed on Sep. 3, 2003 and No. 2004-155029 filed on May 25, 2004.

BACKGROUND OF THE INVENTION

1. Field of the Invention

The present invention relates to a fuel injection pump. For instance, the present invention can be suitably applied to a fuel injection pump used in an accumulation type fuel injection system of a diesel engine.

2. Description of Related Art

There is a fuel injection pump having a camshaft, a cam ring and at least one plunger, for instance, as disclosed in Unexamined Japanese Patent Application Publication No. 2002-364480 (Patent Document 1, hereafter) or No. 2002-250459 (Patent Document 2, hereafter). The camshaft has a cam, which has a circular section, thereon. The cam ring is rotatably fitted to an outer periphery of the cam through a bush. The plunger is held inside a cylinder so that the plunger can reciprocate in the cylinder. If an engine drives the camshaft to rotate, the rotational movement of the cam is transmitted to the plunger through the cam ring. Thus, the plunger reciprocates inside the cylinder and pressure-feeds the fuel. The fuel injection pump has two fuel pressurizing chambers, which are alternately pressurized by the two reciprocating plungers. The fuel injection pump has discharge valves for alternately discharging the fuel pressurized in the fuel pressurizing chambers.

There is a possibility that extraneous matters are mixed into the fuel and get stuck between operating members, which perform rotational movement, reciprocating movement, and the like.

The fuel injection pump disclosed in Patent Document 1 includes a rotary pump for supplying low-pressure fuel into the fuel pressurizing chamber. An inner rotor of the rotary pump is screwed to the camshaft at a predetermined torque through a bolt having a lead directed in the same direction as the rotation direction of the camshaft. If the extraneous matters in the fuel get stuck between gears of the inner rotor and an outer rotor, an abnormal turning force will be generated in the camshaft. In this case, the abnormal turning force will overmatch a force fastening the bolt, and the bolt will be loosened. As a result, the camshaft and the inner rotor are uncoupled.

The fuel injection pump disclosed in Patent Document 2 includes a suction quantity control electromagnetic valve for supplying the fuel into the fuel pressurizing chamber and for controlling the quantity of the fuel pressurized and pressure-fed by the plunger. A valve member and an armature of the suction quantity control electromagnetic valve are formed with penetration passages axially penetrating the valve member and the armature. The suction quantity control electromagnetic valve is formed with a communication passage for connecting an upstream passage of control fuel with an armature chamber. Since a flow of the fuel is generated in the armature chamber, the fuel will not stay around the armature. Therefore, even if the extraneous matters included in the fuel exist in the armature chamber, the extraneous matters will be discharged outward along the flow of the fuel.

Usually, a filter is attached to a fuel inlet portion of the fuel injection pump in order to prevent the entry of the extraneous matters in the fuel from the outside.

The conventional technology can prevent defective operations or damages caused by the extraneous matters included in the fuel but cannot eliminate the extraneous matters sufficiently. The filter disposed in the fuel inlet portion of the fuel injection pump alone cannot sufficiently eliminate the extraneous matters, which can cause the defective operations or the damages.

There is a possibility that the extraneous matters such as burrs or chips generated during the manufacturing of components of the fuel injection pump remain inside. Therefore, the remaining extraneous matters are eliminated through cleaning and the like after the manufacturing. However, a housing has relatively complicated fuel passages among the components. Therefore, actually, there is a possibility that the extraneous matters remain in the fuel passages of the housing because of insufficient cleaning in high-pressure cleaning and the like performed after the manufacturing.

If the extraneous matters remaining because of the insufficient cleaning get stuck in a seat portion of a suction valve or a discharge valve as an operating member, fluid-tightness of the seat portion cannot be maintained and an appropriate fuel pressure-feeding quantity (a discharging quantity) cannot be obtained. If the extraneous matters get stuck in the seat portion of one of the discharge valves, which alternately discharge the fuel pressurized in the two fuel pressurizing chambers, and if the discharge valve is brought to a continuously opened state, the high pressure of the pressurized fuel is continuously applied to the plunger. As a result, poor lubrication will be caused between the plunger and a plunger sliding hole and seizing in the plunger will be caused. If the high pressure is continuously applied to the plunger, an excessive thrust force is applied to the cam ring. In this case, there is a possibility that the plunger breaks.

Moreover, in the case where the fraction produced when the plunger breaks moves inside a cam chamber and gets stuck between the housing and the cam ring, the housing will be damaged if the housing is made of aluminum.

SUMMARY OF THE INVENTION

It is therefore an object of the present invention to eliminate extraneous matters remaining in a fuel injection pump.

It is another object of the present invention to provide a fuel injection pump capable of inhibiting troubles caused by extraneous matters remaining inside.

According to an aspect of the present invention, a fuel injection pump includes a camshaft driven by an internal combustion engine to rotate, a cam rotating with the camshaft, a cam ring revolving around the camshaft so that the cam ring can rotate with respect to the cam along an outer periphery of the cam, a housing for rotatably housing the camshaft, the housing having a fuel pressurizing chamber, a plunger for pressurizing and pressure-feeding fuel, which is drawn into the fuel pressurizing chamber, by reciprocating in accordance with the revolution of the cam ring, and a rotary pump rotated by the camshaft for supplying the fuel, which is drawn into the fuel pressurizing chamber. The housing has a first housing portion for rotatably housing the camshaft, the cam ring and the rotary pump, and a second housing portion for housing the plunger so that the plunger can reciprocate. The first housing portion is formed with a first low-pressure fuel passage for streaming low-pressure fuel from the rotary pump toward the fuel pressurizing chamber. The second housing portion is formed with a second low-pressure fuel passage connected to the fuel pressurizing chamber. The fuel injection pump has a filter disposed in one of an outlet portion of the first low-pressure fuel passage, an inlet portion of the second low-pressure fuel passage facing the outlet portion of the first low-pressure fuel passage, and a certain point in the second low-pressure fuel passage.

In the above structure, even in the case where the extraneous matters remain in the low-pressure fuel passage of the housing because of the insufficient cleaning in the high-pressure cleaning and the like, the extraneous matters can be trapped with the filter. Therefore, the extraneous matters, which can enter the fuel pressurizing chamber pressurizing and pressure-feeding the fuel through the movement of the plunger, are eliminated.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF THE REFERRED EMBODIMENTS

First Embodiment

Figure 1:
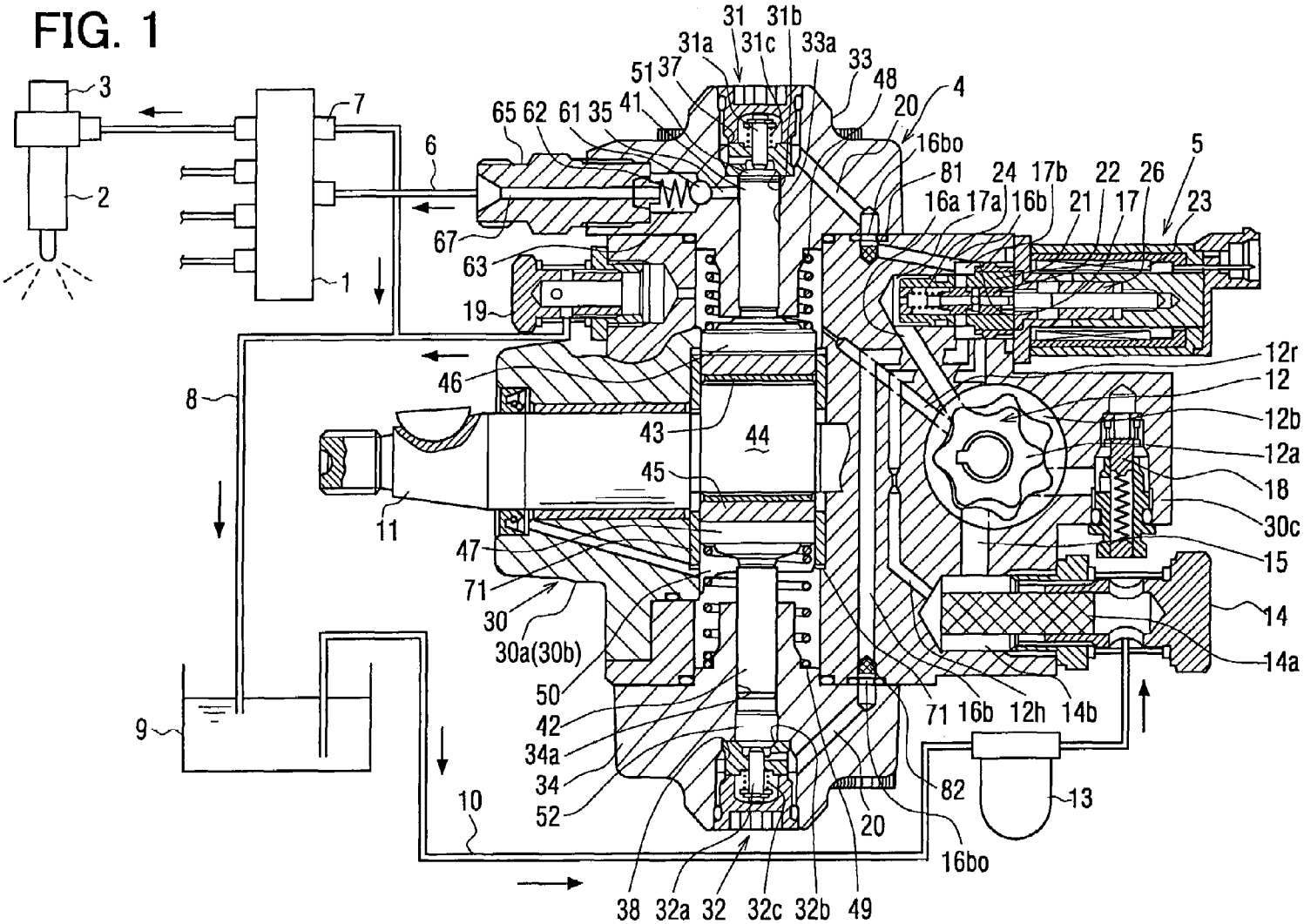
FIG. 1 is a partially-sectional view showing a common rail type fuel injection system including a fuel injection pump according to a first embodiment of the present invention.

Referring to FIG. 1, a common rail type fuel injection system (a pressure accumulation type fuel injection system) including a fuel injection pump 4 according to a first embodiment of the present invention is illustrated.

The common rail type fuel injection system shown in FIG. 1 is used in an internal combustion engine such as a multi-cylinder (four-cylinder, in FIG. 1) diesel engine. The fuel injection system accumulates high-pressure fuel in a common rail 1 and injects the accumulated high-pressure fuel into combustion chambers of respective cylinders of the engine through multiple injectors (electromagnetic fuel injection valves) 2 mounted in accordance with the respective cylinders of the engine. In FIG. 1, only one injector 2 corresponding to one of the cylinders of the four-cylinder engine is illustrated.

The common rail type fuel injection system includes the common rail 1, the multiple injectors 2, the fuel injection pump (the supply pump) 4 and a control device (an electronic control unit, or an ECU) as controlling means. The common rail 1 accumulates the high-pressure fuel. The injectors 2 are mounted on the respective cylinders of the engine and inject the high-pressure fuel accumulated in the common rail 1 into the combustion chambers of the respective cylinders. The supply pump 4 pressurizes the fuel and supplies the fuel toward the common rail 1. The ECU controls a valve opening operation and a valve closing operation of the multiple injectors 2 (more specifically, electromagnetic valves 3) and the supply pump 4 (more specifically, a suction quantity control electromagnetic valve 5), for instance.

In order to continuously accumulate the fuel in the common rail 1 at a high pressure corresponding to a fuel injection pressure, the high-pressure fuel is pressure-fed from the supply pump 4 into the common rail 1 through a high-pressure fuel pipe 6. A fuel pressure sensor and a pressure limiter 7 are mounted to the common rail 1. The fuel pressure sensor senses the fuel pressure in the common rail 1 (a common rail pressure). If the common rail pressure exceeds a limit set pressure, the pressure limiter 7 opens in order to limit the common rail pressure below the limit set pressure.

The fuel injection from the injector 2 into the combustion chamber is controlled by energizing and de-energizing the electromagnetic valve 3. The electromagnetic valve 3 controls the fuel pressure in a back pressure control chamber, which drives a command piston moving with a nozzle needle. More specifically, while the electromagnetic valve 3 of the injector 2 is energized and the nozzle needle is opened, the high-pressure fuel accumulated in the common rail 1 is supplied into the combustion chamber of each cylinder through the injection. Thus, the engine is operated.

Surplus fuel such as leak fuel from a high-pressure fuel system including the injectors 2, the supply pump 4 and the pressure limiter 7 is returned to a fuel tank 9 through a fuel return pipe 8.

Next, a structure of the supply pump 4 will be explained based on FIGS. 1 and 2. As shown in FIG. 1, the supply pump 4 includes a camshaft 11 as a pump drive shaft, a cam 44 rotating with the camshaft 11, a cam ring 45 revolving around the camshaft 11 along an outer periphery of the cam 44, first and second plungers 41, 42, a rotary pump 12, the suction quantity control electromagnetic valve 5 as a control valve, check valves 31, 32 as first and second suction valves 31, 32, discharge valves 61 and a housing 30, in which the above components are housed or mounted.

As shown in FIG. 1, the camshaft 11 as the pump drive shaft rotated by the engine is rotatably held in the housing 30. A drive pulley is attached to an outer periphery of a tip end (the left end in FIG. 1) of the camshaft 11. The drive pulley is linked with a crank pulley of a crankshaft of the engine through a driving force transmitting member such as a belt and is driven. A rotary pump (a feed pump) 12 for supplying the low-pressure fuel is connected to the other tip end (the right end in FIG. 1) of the camshaft 11. The feed pump 12 rotates integrally with the camshaft 11 and draws the fuel from the fuel tank 9 through a fuel supply passage 10. In FIG. 1, the feed pump 12 is illustrated in a state in which the feed pump 12 is rotated by an angle of 90°. The feed pump 12 may have any type of pump structure such as a vane type pump structure, instead of the inner gear type pump structure shown in FIG. 1. The inner gear type pump 12 includes an inner rotor 12*a*, which is fitted to the camshaft 11 with a clearance, and an outer rotor 12*b*, which is driven by the inner rotor 12*a* in sun-and-planet motion.

A fuel filter 13 is disposed in the fuel supply passage 10. The fuel filter 13 filters or traps impurities in the fuel drawn from the fuel tank 9 into the feed pump 12.

As shown in FIG. 1, an inlet (a fuel inlet portion) 14 and a fuel introduction passage 15 are formed on a suction side of the feed pump 12. The inlet 14 includes a sleeve nipple and a screw and introduces the fuel into the housing 30 from the outside. The fuel introduction passage 15 connects the inlet 14 with the feed pump 12. The inlet 14 incorporates a filter (a suction portion filter) 14*a* as shown in FIG. 1. A discharge side of the feed pump 12 is connected with the suction quantity control electromagnetic valve 5 (more specifically, a fuel sump chamber 17*a* on the tip end side of the suction quantity control electromagnetic valve 5) through a fuel leading passage 16*a*. The fuel sump chamber 17*a* is a space provided by an accommodation hole 17 of the suction quantity control electromagnetic valve 5 formed in the housing 30 and the tip end portion (the left end in FIG. 1) of the suction quantity control electromagnetic valve 5 accommodated in the accommodation hole 17. The accommodation hole 17 is a stepped hole having a bottom. The accommodation hole 17 is provided by a hole portion with the bottom having substantially the same internal diameter as a valve housing 21 explained after, and a control fuel storage portion, whose internal diameter is larger than the hole portion. A space defined by the valve housing 21 and the control fuel storage portion provides a control fuel (low-pressure fuel) storage chamber 17*b*.

A mesh size of the suction portion filter 14*a* of the inlet 14 should be preferably smaller than that of the fuel filter 13. The fuel introduction passage 15 is formed with a suction hole 14*b* on the inlet 14 side. The inlet 14 can be connected to the suction hole 14*b* through screwing and the like.

The inlet 14 and the fuel introduction passage 15 (more specifically, the suction hole 14*b*) provide a suction portion for introducing the fuel from the outside. The suction portion filter 14*a* is incorporated by the inlet 14. Alternatively, the suction portion filter 14*a* may be disposed in the suction hole 14*b* or in the fuel introduction passage 15 if the suction portion filter 14*a* is disposed inside the suction portion, which introduces the fuel from the outside.

A pressure regulation valve (a regulation valve) 18 is disposed near the feed pump 12 as shown in FIG. 1. The regulation valve 18 prevents the discharging pressure of the low-pressure fuel discharged from the feed pump 12 into the fuel sump chamber 17*a* of the suction quantity control electromagnetic valve 5 from exceeding a predetermined fuel pressure.

The suction quantity control electromagnetic valve 5 is a normally-open type electromagnetic flow control valve as shown in FIG. 1. The suction quantity control electromagnetic valve 5 has a valve member (a valve) 22, which is slidably held inside a sleeve-shaped valve housing 21, an electromagnetic driving portion 23 as valve driving means for driving the valve 22 in a valve closing direction, and a coil spring 24 as valve biasing means for biasing the valve 22 in a valve opening direction. When energized, the electromagnetic driving portion 23 generates an electromagnetic force and attracts a movable member (an armature) 26, which moves with the valve 22. The valve 22 is opened by the biasing force of the coil spring 24 when the electromagnetic driving portion 23 is de-energized. If the electromagnetic driving portion 23 is energized, the valve 22 opens against the biasing force of the coil spring 24. The valve 22 and the valve housing 21 provide a valve portion for performing valve opening operation and valve closing operation.

Instead of the electromagnetic flow control valve shown in FIG. 1, the suction quantity control electromagnetic valve 5 may be any type of electromagnetic valve if the suction quantity-control electromagnetic valve 5 has the valve portion 21, 22 for streaming or blocking the control fuel, and the electromagnetic driving portion 23 for driving the valve portion 21, 22 to perform the valve opening operation and the valve closing operation. The clearance between the valve 22 and the valve housing 21 and an armature chamber accommodating the armature 26 of the electromagnetic driving portion 23 should be preferably formed so that the fuel flows through the clearance and the armature chamber without staying there.

As shown in FIG. 1, surplus fuel, which is generated when the suction quantity control electromagnetic valve 5 controls the flow of the fuel, is returned to the suction side of the feed pump 12 through a fuel return passage 12*h* connected to the suction quantity control electromagnetic valve 5, and the fuel introduction passage 15. Part of the fuel discharged from the feed pump 12 is introduced into the cam chamber 5 through a fuel lubrication passage 12*r* connected to the feed pump 12 and lubricates various sliding portions such as the plungers 41, 42. Then, the fuel flows out of the supply pump 4 through an outlet (a fuel outlet portion) 19, which is provided by a sleeve nipple and a screw. The fuel flowing out of the outlet 19 is returned to the fuel tank 9 through the fuel return passage 8. The fuel return passage 12*h* and the fuel introduction passage 15 constitute a fuel suction passage for introducing the fuel into the feed pump 12. The fuel lubrication passage 12*r* and the cam chamber 50 constitute a return fuel passage for lubricating the various sliding portions of the various operating members and for returning the surplus fuel.

As shown in FIG. 1, the control fuel (the low-pressure fuel) controlled by the suction quantity control electromagnetic valve 5 flows out to the control fuel storage chamber 17*b*. The low-pressure fuel is drawn into multiple fuel pressurizing chambers 51, 52 through multiple (two, in FIG. 1) control fuel passages 16*b* and the multiple suction valves 31, 32. More specifically, the control fuel storage chamber 17*b* communicates with the control fuel passage 16*b* and the fuel suction passage 20 in that order. The fuel suction passage 20 communicates with one of the suction valves 31, 32. The fuel pressurizing chambers 51, 52 are spaces defined by the plungers 41, 42 and the suction valves 31, 32 for storing the fuel. The number of the control fuel passages 16*b* or the fuel suction passages 20 is set in accordance with the number of the fuel pressurizing chambers 51, 52 (more specifically, the number of the plungers 41, 42).

The first suction valve 31 and the first fuel pressurizing chamber 51 correspond to the first plunger 41. The second suction valve 32 and the second fuel pressurizing chamber 52 correspond to the second plunger 42.

The fuel leading passage 16*a*, the fuel sump chamber 17*a*, the control fuel storage chamber 17*b*, the control fuel passage 16*b* and the fuel suction passage 20 constitute the low-pressure fuel passage. The suction quantity control electromagnetic valve 5 is disposed in the low-pressure fuel passage.

The first suction valve 31 is a check valve, whose forward direction coincides with the flow direction of the fuel flowing from the feed pump 12 toward the first fuel pressurizing chamber 51. The first suction valve 31 includes a valve member 31*a* and a coil spring 31*c* as biasing means for biasing the valve member 31*a* in a direction for seating the valve member 31*a* on a valve seat 31*b*. The first suction valve 31 functions as a check valve for preventing backflow of the fuel from the first fuel pressurizing chamber 51 toward the suction quantity control electromagnetic valve 5. In a normal state, the first valve member 31*a* is biased by the biasing force of the coil spring 31*c* upward in FIG. 1 and is seated on the valve seat 31*b*. Thus, the first suction valve 31 is closed. If the low-pressure fuel flows in from the suction quantity control electromagnetic valve 5 through the fuel suction passage 20, the fuel pressure of the low-pressure fuel opens the first valve member 31*a* and the fuel is drawn into the first fuel pressurizing chamber 51. If the first plunger 41 moves and pressurizes the fuel in the first fuel pressurizing chamber 51, the valve member 31*a* of the first suction valve 31 is closed by the fuel pressure in the first fuel pressurizing chamber 51, and the state is retained until the pressure-feeding of the fuel is finished.

Likewise, the second suction valve 32 is a check valve, whose forward direction coincides with the flow direction of the fuel flowing from the feed pump 12 toward the second fuel pressurizing chamber 52. The second suction valve 32 includes a valve member 32*a* and a coil spring 32*c* as biasing means for biasing the valve member 32*a* in a direction for seating the valve member 32*a* on a valve seat 32*b*. The second suction valve 32 functions as a check valve for preventing backflow of the fuel from the second fuel pressurizing chamber 52 toward the suction quantity control electromagnetic valve 5. In a normal state, the valve member 32*a* is biased by the biasing force of the coil spring 32*c* downward in FIG. 1 and is seated on the valve seat 32*b*. If the low-pressure fuel flows in from the suction quantity control electromagnetic valve 5 through the fuel suction passage 20, the fuel pressure of the low-pressure fuel opens the valve member 32*a* and the fuel is drawn into the second fuel pressurizing chamber 52. If the second plunger 42 moves and pressurizes the fuel in the second fuel pressurizing chamber 52, the valve member 32*a* of the second suction valve 32 is closed by the fuel pressure in the second fuel pressurizing chamber 52, and the state is retained until the pressure-feeding of the fuel is finished.

In the present embodiment, the first suction valve 31 is disposed short of the first fuel pressurizing chamber 51 in the low-pressure fuel passage. More specifically, the first suction valve 31 is disposed at a point where the first suction valve 31 and the first plunger 41 define the first fuel pressurizing chamber 51. Instead, the first suction valve 31 may be disposed in the fuel suction passage 20 connected to the first fuel pressurizing chamber 51.

The second suction valve 32 is disposed short of the second fuel pressurizing chamber 52 in the low-pressure fuel passage. More specifically, the second suction valve 32 is disposed at a point where the second suction valve 32 and the second plunger 42 define the second fuel pressurizing chamber 52. Instead, the second suction valve 32 may be disposed in the fuel suction passage 20 connected to the second fuel pressurizing chamber 52.

As shown in FIG. 1, the cam (the eccentric cam) 44 is integrally formed on an outer periphery of an intermediate portion of the camshaft 11. The two plungers 41, 42 are disposed at substantially symmetric positions across the eccentric cam 44 along the vertical direction in FIG. 1. The eccentric cam 44 is disposed eccentrically with respect to the axial center of the camshaft 11 and has a substantially circular section.

A cam ring 45 having a substantially rectangular profile is slidably held on the outer periphery of the eccentric cam 44 through a ring-shaped bush 43. A hollow portion having a substantially circular section is formed in the cam ring 45. The bush 43 and the eccentric cam 44 are housed inside the hollow portion. Plate members 46, 47 respectively integrated with the two plungers 41, 42 are disposed respectively on the upper end surface and the lower end surface of the cam ring 45 in FIG. 1. The plate members 46, 47 are pressed against the upper end surface and the lower end surface of the cam ring 45 in FIG. 1 by biasing forces of coil springs 48, 49, which are disposed around the outer peripheries of the plungers 41, 42 respectively. The eccentric cam 44 and the cam ring 45 are made of metallic material and are rotatably housed inside the cam chamber 50 formed in the housing 30.

As shown in FIG. 1, the plungers 41, 42 are housed in sliding holes of the housing 30 (more specifically, sliding holes 33*a*, 34*a* of second housing portions 33, 34) respectively so that the plungers 41, 42 can reciprocate in a sliding manner. The first fuel pressurizing chamber 51 is provided by an inner peripheral surface of the sliding hole 33*a* and the first suction valve 31 (more specifically, the valve member 31*a*) on the upper end surface of the first plunger 41 in FIG. 1. The second fuel pressurizing chamber 52 is provided by an inner peripheral surface of the sliding hole 34*a* and the second suction valve 32 (more specifically, the valve member 32*a*) on the lower end surface of the second plunger 42 in FIG. 1.

The first discharge valve 61 is connected with the first fuel pressurizing chamber 51 through a first fuel pressure-feeding passage 35. The second discharge valve is connected with the second fuel pressurizing chamber 52 through a second fuel pressure-feeding passage. The first discharge valve 61 and the second discharge valve function as check valves for preventing backflow of the high-pressure fuel from a first discharge hole 63 and a second discharge hole toward the first fuel pressurizing chamber 51 and the second fuel pressurizing chamber 52 respectively. The first discharge valve 61 and the second discharge valve include ball valves 35 and coil springs 62 respectively. The high-pressure fuel discharged from the first discharge hole 63 and the second discharge hole flows into a high-pressure fuel pipe 6 through a fuel pressure-feeding passage 67 inside a first pipe connector (a delivery valve holder) 65 and a fuel pressure-feeding passage inside a second delivery valve holder, and is supplied into the common rail 1. The fuel pressure-feeding passage 35, the first discharge hole 63 and the fuel pressure-feeding passage 67 constitute a high-pressure fuel pressure-feeding passage. The first discharge valve 61 is disposed in the high-pressure fuel pressure-feeding passage.

The first discharge valve 61 and the delivery valve holder 65 constitute a discharge portion for discharging the fuel to the outside (more specifically, to the common rail 1 and the like through the high-pressure fuel pipe 6). The inlet portion 14, 14*b*, 15, the low-pressure fuel passage 16*a*, 17*a*, 17*b*, 16*b*, 20 and the high-pressure fuel pressure-feeding passage 35, 63, 67 provide a fuel passage leading from the suction portion 14, 14*b*, 15 (more specifically, the suction portion filter 14*a*) to the discharge portion 61, 65 through the fuel pressurizing chamber 51. In the above fuel passage, a passage leading from the feed pump 12 (more specifically, the discharge side of the feed pump 12) to the discharge portion 61, 65 through the fuel pressurizing chamber 51 provides a fuel passage portion.

The housing 30 is made of metallic material and has a first housing portion 30*a* and the second housing portions 33, 34. The first housing portion 30*a* rotatably houses the camshaft 11, the cam ring 45 and the feed pump 12. The second housing portions 33, 34 house the first and second plungers 41, 42 respectively so that the plungers 41, 42 can reciprocate in a sliding manner. More specifically, the camshaft 11 is rotatably housed in the first housing portion 30*a* through a bearing so that the tip end (the left end in FIG. 1) of the camshaft 11 is inserted through the first housing portion 30*a*. The first housing portion 30*a* is formed with the fuel leading passage 16*a*, the fuel sump chamber 17*a*, the control fuel storage chamber 17*b* and the control fuel passage 16*b* of the low-pressure fuel passage formed in the housing 30. In addition, the first housing portion 30*a* is formed with the fuel lubrication passage 12*r* out of the fuel suction passage 12*h*, 15 and the return fuel passage 12*r*, 50.

The fuel leading passage 16*a*, the fuel sump chamber 17*a*, the control fuel storage chamber 17*b* and the control fuel passage 16*b* constitute a first low-pressure fuel passage. The suction quantity control electromagnetic valve 5 is disposed in the first low-pressure fuel passage.

Moreover, the first housing portion 30*a* is divided into a bearing housing portion (a bearing portion) 30*b* for rotatably bearing the camshaft 11, and a main body portion 30*c* for rotatably housing the feed pump 12. The bearing portion 30*b* and the main body portion 30*c* are integrated with each other after the camshaft 11 is inserted through the bearing portion 30*b* and the main body portion 30*c*. Alternatively, the first housing portion 30*a* may be formed in a single piece. In the present embodiment, the main body portion 30*c* is formed with the first low-pressure fuel passage 16*a*, 17*a*, 17*b*, 16*b*, the fuel suction passage 12*h*, 15 and the fuel lubrication passage 12*r*. The suction quantity control electromagnetic valve 5, the inlet 14 and the outlet 19 can be attached to the main body portion 30*c*.

The two second housing portions 33, 34 are fluid-tightly fixed to the upper and lower end surfaces of the first housing portion 30*a* in FIG. 1. The second housing portions 33, 34 and the first housing portion 30*a* define the cam chamber 50. The cam chamber 50 houses the sliding members such as the eccentric cam 44 and the cam ring 45, the plungers 41, 42 and the coil springs 48, 49 for pressing the plate members 46, 47 against the cam ring 45. Two thrust washers 71 are interposed between ring-shaped inner wall surfaces of the cam chamber 50 and both end surfaces of the eccentric cam 44 along the thrust direction (the axial direction). Thus, the eccentric cam 44, the bush 43, the cam ring 45 and the plate members 46, 47 can rotate or reciprocate easily. Meanwhile, the position of the cam ring 45 in the thrust direction is determined. Each washer 71 has an external diameter corresponding to the area of the revolution of the cam ring 45. In order to prevent the washers 71 from rotating with the cam ring 45, the washers 71 should be preferably fixed to both end surfaces of the cam chamber 50 in the thrust direction.

As shown in FIG. 1, the second housing portions 33, 34 are formed with the sliding holes 33*a*, 34*a* respectively. The plungers 41, 42 are housed respectively inside the sliding holes 33*a*, 34*a* so that the plungers 41, 42 can reciprocate in the sliding manner. The second housing portions 33, 34 are formed with the fuel pressurizing chambers 51, 52, which are provided by the end surfaces of the plungers 41, 42, the inner peripheral surfaces of the sliding holes 33*a*, 34*a* and the suction valves 31, 32 (more specifically, the valve members 31*a*, 32*a*) respectively. The second housing portions 33, 34 are formed with the fuel suction passages 20 of the low-pressure fuel passage formed in the housing 30. More specifically, the second housing portions 33, 34 are formed with accommodation holes 37, 38 for accommodating the suction valves 31, 32, and the fuel suction passages 20 are connected to the accommodation holes 37, 38. The second housing portions 33, 34 are formed with the high-pressure fuel pressure-feeding passages 35, 63, 67. The discharge valve 61 and the delivery valve holder 65 are disposed in the high-pressure fuel pressure-feeding passage 35, 63, 67. The fuel suction passage 20 provides a second low-pressure fuel passage.

The second housing portions 33, 34 and the plungers 41, 42 constitute pump elements (high-pressure supply pumps) of the supply pump 4 respectively. The second housing portions 33, 34 constituting the pump elements are cylinder heads. The second housing portions 33, 34 are made of metallic material having mechanical strength such as abrasion resistance and seizing resistance. The first housing portion 30*a* except the bearing for rotatably holding the camshaft 11 is made of aluminum such as die-cast aluminum or aluminum alloy.

Figure 2:
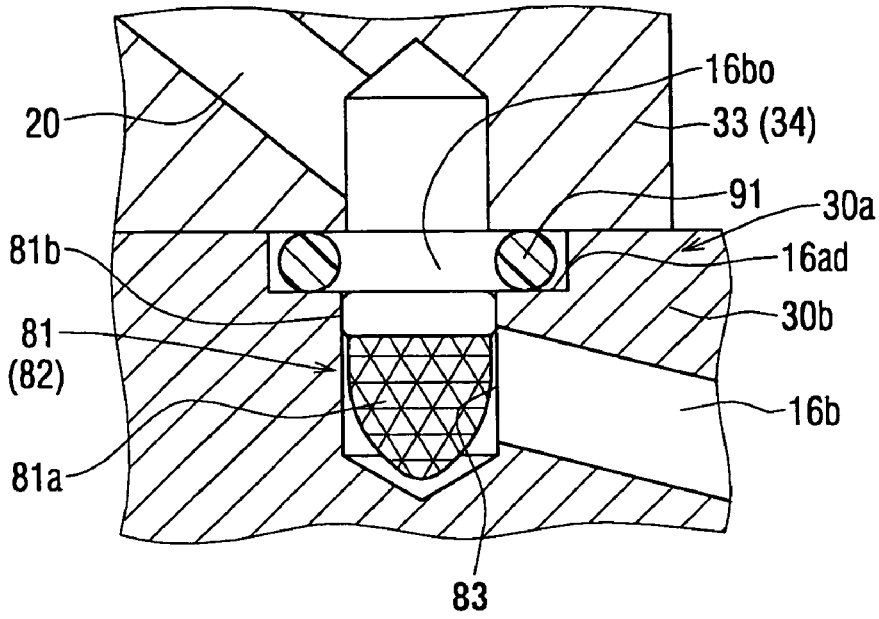
FIG. 2 is an enlarged fragmentary sectional view showing a neighborhood of a low-pressure fuel passage of the fuel injection pump according to the first embodiment.

Moreover, in the present embodiment, as shown in FIGS. 1 and 2, filters 81, 82 are disposed at the outlet portions of the first low-pressure fuel passage 16*a*, 17*a*, 17*b*, 16*b* formed in the first housing portion 30*a* (more specifically, the main body portion 30*c*). More specifically, the filters 81, 82 are disposed on outlet 16*bo* sides of the control fuel passages 16*b* formed in the first housing portion 30*a* (more specifically, the main body portion 30*c*). The filters 81, 82 are fixed into holes (fitting holes) 83 of the control fuel passages 16*b* formed on the upper and lower end surfaces of the first housing portion 30*a* in FIG. 1 through fitting fixation and the like. As shown in FIG. 2, the filters 81, 82 respectively include metallic mesh portions 81*a*, 82*a* made of stainless steel metallic meshes or the like, and guide portions 81*b*, 82*b* for holding the metallic mesh portions 81*a*, 82*a*. The metallic mesh portions 81*a*, 82*a* are formed substantially in the shape of cones and trap extraneous matters. The external diameters of the guide portions 81*b*, 82*b* are set so that the guide portions 81*b*, 82*b* can be fitted into the fitting holes 83. The filters 81, 82 are inserted and fixed so that the tip ends of the substantially conical shapes of the metallic mesh portions 81*a*, 82*a* are directed upstream with respect to the flow of the fuel. The filters 81, 82 should be preferably mounted so that the filters 81, 82 do not protrude from the upper end surface and the lower end surface of the first housing portion 30*a* (more specifically, the main body portion 30*c*) in FIG. 1.

The mesh size of each one of the filters 81, 82 should be preferably set at a small size in a mesh range, in which the fuel supply quantity (the fuel pressure-feeding quantity) of the fuel supplied from the suction quantity control electromagnetic valve 5 to the fuel pressurizing chambers 51, 52 is not restricted below an appropriate quantity.

Stepped portions 16*ad* continuing to the fitting holes 83 are formed on the upper end surface and the lower end surface of the first housing portion 30*a* in FIG. 1, and sealing members 91 such as O rings are disposed on the stepped portions 16*ad* as shown in FIG. 2 so that the first housing portion 30*a* and the second housing portions 33, 34 can hold the fluid-tightness.

Next, an operation of the supply pump 4 having the above structure will be explained. If the camshaft 11 is rotated by the engine, the feed pump 12 is driven by the rotational movement of the camshaft 11. If the feed pump 12 starts the drive, the fuel in the fuel tank 9 is introduced into the fuel introduction passage 15 through the fuel supply passage 10, the fuel filter 13 and the inlet 14, and is drawn into the suction side of the feed pump 12. The feed pump 12 pressurizes the drawn fuel to a predetermined pressure and discharges the low-pressure fuel into the fuel sump chamber 17*a* of the suction quantity control electromagnetic valve, 5 through the fuel leading passage 16*a*. At that time since the eccentric cam 44 integrated with the camshaft 11 rotates, the cam ring 45 revolves along a predetermined substantially circular passage of the cam, 44. As a result, the plate members 46, 47 reciprocate on the upper and lower end surfaces of the cam ring 45 in FIG. 1. Accordingly, the first and second plungers 41, 42 reciprocate inside the sliding holes 33*a*, 34*a* in the vertical direction in FIG. 1. Thus, the first and second plungers 41, 42 pressurize the fuel in the first and second pressurizing chambers 51, 52 and pressure-feed the high-pressure fuel. More specifically, if the first plunger 41 moves from a top dead center to a bottom dead center in the sliding hole 33*a* in a suction stroke, the low-pressure fuel discharged from the feed pump 12 opens the first suction valve 31 and flows into the first fuel pressurizing chamber 51. Then, the first plunger 41 having reached the bottom dead center moves toward the top dead center in the sliding hole 33*a* in a pressure-feeding stroke, and the fuel pressure in the first fuel pressurizing chamber 51 is increased in accordance with the increase in the lifting degree of the first plunger 41. Likewise, if the second plunger 42 moves from a top dead center to a bottom dead center in the sliding hole 34*a* in a suction stroke, the low-pressure fuel discharged from the feed pump 12 opens the second suction valve 32 and flows into the second fuel pressurizing chamber 52. Then, the second plunger 42 having reached the bottom dead center moves toward the top dead center in the sliding hole 34*a* in a pressure-feeding stroke, and the fuel pressure in the second fuel pressurizing chamber 52 is increased in accordance with the increase in the lifting degree of the second plunger 42. If the discharge valve 61 is opened by the increased fuel pressure, the high-pressure fuel pressurized in the fuel pressurizing chamber 51 flows out of the fuel pressure-feeding passage 67 in the delivery valve holder 65 through the fuel pressure-feeding passage 35 and the discharge hole 63. Then, the high-pressure fuel flowing out of the fuel pressure-feeding passage 67 is pressure-fed into the common rail 1 through the high-pressure fuel pipe 6.

The eccentric cam 44 is eccentric with respect to the camshaft 11. Therefore, as shown in FIG. 1, the first plunger 41 and the second plunger 42 reciprocate alternately. In FIG. 1, the first plunger 41 is in a state of a maximum cam lift (a maximum plunger lift), or in an upper dead center state, after moving upward. The second plunger 42 is in a state of a minimum cam lift (a minimum plunger lift), or in a bottom dead center state, after moving upward in FIG. 1.

Next, an effect of the present embodiment will be explained. The housing 30 includes the first housing portion 30*a* for rotatably housing the feed pump 12, and the second housing portions 33, 34 for housing the plungers 41, 42 so that the plungers 41, 42 can reciprocate. Thus, the housing 30 is made up of the separate components. Therefore, the filters 81, 82 can be easily mounted. The first low-pressure fuel passage 16*a*, 17*a*, 17*b*, 16*b* is formed in the first housing portion 30*a* for providing the passages for streaming the low-pressure fuel from the feed pump 12 toward the fuel pressurizing chambers 51, 52. Each one of the filters 81, 82 is disposed in the outlet portion of the first low-pressure fuel passage 16*a*, 17*a*, 17*b*, 16*b*, or on the outlet 16*bo* side of the control fuel passage 16*b*. Therefore, even if the extraneous matters remain in the first low-pressure fuel passage 16*a*, 17*a*, 17*b*, 16*b* of the housing 30 (more specifically, the first housing portion 30*a*) because of insufficient cleaning in high-pressure cleaning, the extraneous matters are trapped with the filters 81, 82. Therefore, the extraneous matters, which can enter the fuel pressurizing chambers 51, 52, are eliminated.

Moreover, in the present embodiment, the suction valves 31, 32 are disposed short of the fuel pressurizing chambers 51, 52 in the second low-pressure fuel passages (the fuel suction passages) 20 communicating with the fuel pressurizing chambers 51, 52 in the second housing portions 33, 34. The suction valves 31, 32 are disposed downstream of the filters 81, 82 with respect to the flow of the fuel. Therefore, the extraneous matters, which can enter the suction valves 31, 32, are eliminated by the filters 81, 82. Accordingly, the troubles due to the extraneous matters, which will degrade performance and reliability of the suction valves 31, 32, can be prevented.

In the present embodiment, the suction quantity control electromagnetic valve 5 is disposed in the first low-pressure fuel passage 16*a*, 17*a*, 17*b*, 16*b* of the first housing portion 30*a*. The suction quantity control electromagnetic valve 5 controls the quantity of the fuel flowing through the suction valves 31, 32, or the suction quantity of the fuel drawn into the fuel pressurizing chambers 51, 52 corresponding to the pressure-feeding quantity (the discharging quantity) of the fuel. Therefore, the first low-pressure fuel passage 16*a*, 17*a*, 17*b*, 16*b* formed inside the first housing portion 30*a* is prone to be complicated. However, even if the extraneous matters remain because of the insufficient cleaning in the high-pressure cleaning performed after the first low-pressure fuel passage 16*a*, 17*a*, 17*b*, 16*a* is formed in the manufacturing of the first housing portion 30*a*, the extraneous matters can be trapped with the filters 81, 82. Therefore, the troubles caused by the extraneous matters, which will degrade the performance and the reliability of the suction valves 31, 32, the plungers 41, 42 and the discharge valve 61, can be prevented.

Each one of the fuel pressurizing chambers 51, 52 communicates with the high-pressure fuel pressure-feeding passage 35, 63, 67 for discharging the high-pressure fuel toward the common rail 1. Each one of the discharge valves 61 is disposed in the high-pressure fuel pressure-feeding passage 35, 63, 67. Thus, a trouble that the extraneous matters get stuck in the seat portion of one of the discharge valves 61, which alternately discharge the fuel pressurized in the two fuel pressurizing chambers 51, 52, and the discharge valve 61 is brought to a continuously opened state can be prevented. As a result, secondary troubles such as the seizure or the breakage of the plungers 41, 42 can be prevented.

In the present embodiment, the housing 30 has the suction portion filter 14*a* in the suction portion 14, 14*b*, 15 for introducing the fuel from the outside. The housing 30 is formed with the fuel passage leading from the suction portion filter 14*a* to the discharge portions 61, 65 through the fuel pressurizing chambers 51, 52 for discharging the fuel. The filters 81, 82 may be disposed in the above fuel passage. By disposing the filters 81, 82 in the fuel passage leading from the suction portion filter 14*a* to the discharge portions 61, 65 through the fuel pressurizing chambers 51, 52, the extraneous matters can be trapped with the filters 81, 82 even if the extraneous matters remain in the fuel passage because of the insufficient cleaning in the high-pressure cleaning.

The filters 81, 82 should be preferably disposed in the fuel passage portion leading from the feed pump 12 disposed downstream of the suction portion filter 14*a* to the discharge portion 61, 65 through the fuel pressurizing chamber 51, 52 in the fuel passage. Thus, even if the extraneous matters remain in the fuel passage of the housing 30 because of the insufficient cleaning in the high-pressure cleaning, the extraneous matters, which can enter the suction valves 31, 32 or the discharge valves 61 of the discharge portions 61, 65, are trapped with the filters 81, 82.

Second Embodiment

Next, a fuel injection pump (a supply pump) 4 according to a second embodiment of the present invention will be explained based on FIG. 3.

Figure 3:
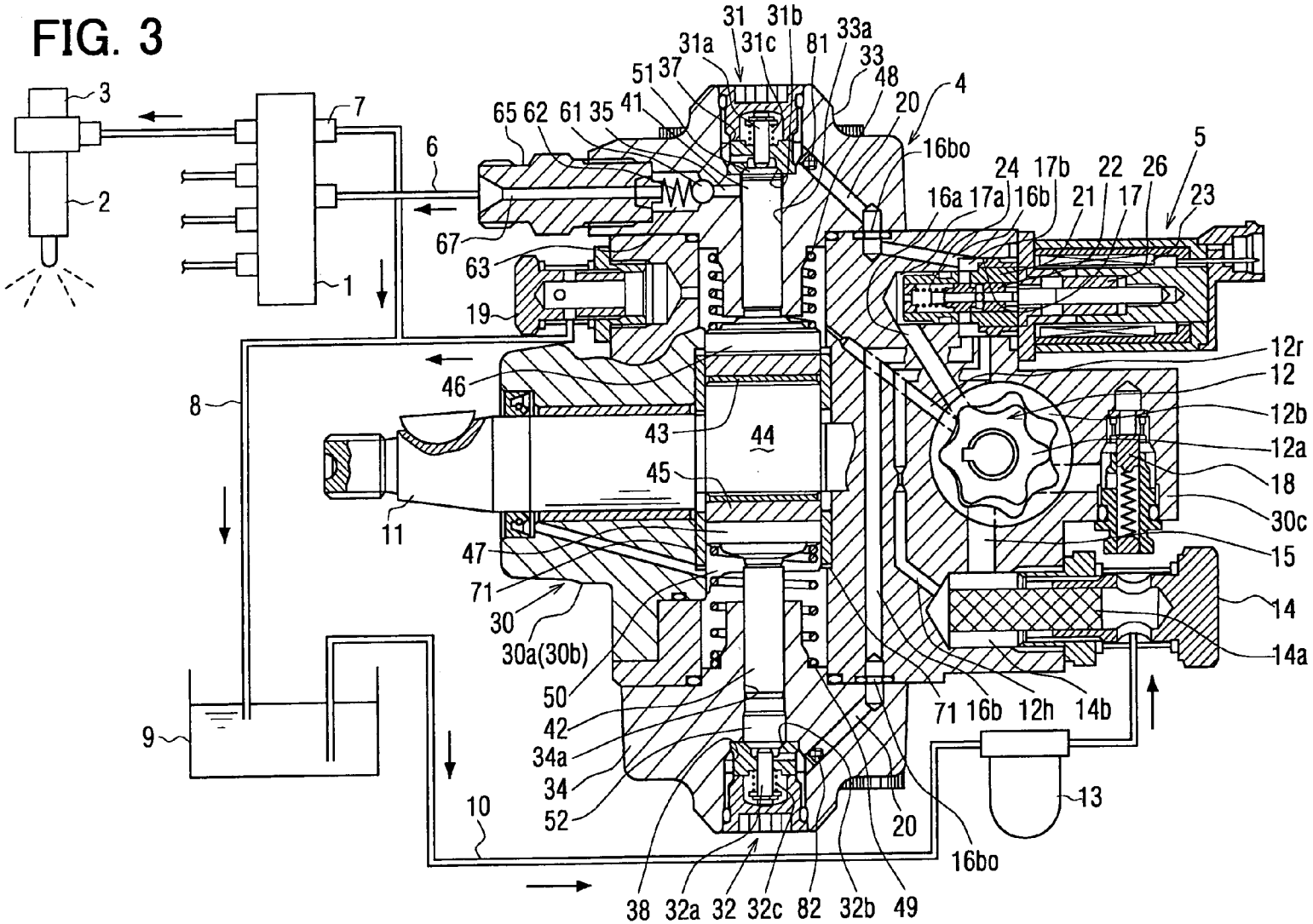
FIG. 3 is a partially-sectional view showing a common rail type fuel injection system including a fuel injection pump according to a second embodiment of the present invention.

In the second embodiment, the filters 81, 82 are disposed in the second low-pressure fuel passages (the fuel suction passages) 20 as shown in FIG. 3, instead of disposing the filters 81, 82 on the sides of the outlets 16*bo* of the first low-pressure fuel passage 16*a*, 17*a*, 17*b*, 16*b* as in the first embodiment.

More specifically, as shown in FIG. 3, the second housing portions 33, 34 are formed with the accommodation holes 37, 38 for accommodating the suction valves 31, 32. The filters 81, 82 are fixed to the openings of the second low-pressure fuel passages 20 communicating with the accommodation holes 37, 38 through fitting fixation and the like.

An effect similar to the effect of the first embodiment can be obtained by disposing the filters 81, 82 in the second low-pressure fuel passages 20 downstream of the first low-pressure fuel passage 16*a*, 17*a*, 17*b*, 16*b* in the low-pressure fuel passage 16*a*, 17*a*, 17*b*, 16*b*, 20, through which the low-pressure fuel flows from the feed pump 12 toward the pressurizing chambers 51, 52.

Moreover, in the second embodiment, each one of the filters 81, 82 is disposed in one of both openings of the second low-pressure fuel passage 20 on the side connected to each one of the accommodation holes 37, 38. More specifically, the filters 81, 82 are disposed in the outlets of the second housing portions 33, 34 with respect to the flow of the fuel. Thus, manufacturing and assembly for mounting the filters 81, 82 to the second housing portions 33, 34 can be facilitated.

Instead, the filters 81, 82 may be disposed in the other openings of the second low-pressure fuel passages 20 facing the outlet portions 16*bo*. More specifically, the filters 81, 82 may be disposed in the inlets of the second low-pressure fuel passages 20 with respect to the flow of the fuel. Also in this case, the manufacturing and the assembly for mounting the filters 81, 82 to the second housing portions 33, 34 can be facilitated.

The fuel flow passage of the second low-pressure fuel passage 20 is formed relatively simply, compared to the first low-pressure fuel passage 16*a*, 17*a*, 17*b*, 16*b*. Therefore, there is little or no possibility that the extraneous matters remaining because of the insufficient cleaning in the high-pressure cleaning of the second housing portions 33, 34 stay in the second low-pressure fuel passages 20. Therefore, an effect similar to the effect of the first embodiment can be obtained even if the filters 81, 82 are disposed in the inlet portions of the second low-pressure fuel passages 20 facing the outlet portions 16*bo* or in the openings (the outlet portions) on the sides communicating with the accommodation holes 37, 38.

In the above embodiments, the housing 30 includes the first housing portion 30*a* and the second housing portions 33, 34, so the housing 30 is made up of the separate components. The first housing portion 30*a* rotatably houses the camshaft 11, the cam ring 45 and the feed pump 12. The second housing portions 33, 34 house the plungers 41, 42 in the sliding holes 33*a*, 34*a* so that the plungers 41, 42 can reciprocate. Moreover, each one of the filters 81, 82 is disposed in one of the outlet portion of the first low-pressure fuel passage 16*a*, 17*a*, 17*b*, 16*b* formed in the first housing portion 30*a*, the inlet portion of the second low-pressure fuel passage 20 facing the outlet portion of the first low-pressure fuel passage, and the second low-pressure fuel passage 20 leading from the inlet portion to each one of the pressurizing chambers 51, 52. Therefore, even if the extraneous matters remain in the first low-pressure fuel passage 16*a*, 17*a*, 17*b*, 16*b* because of the insufficient cleaning in the high-pressure cleaning, the extraneous matters can be trapped with the filters 81, 82. Therefore, the troubles, which are caused by the extraneous matters and degrade the performance and the reliability of the suction valves 31, 32, the plungers 41, 42 and the discharge valve 61, can be prevented.

Third Embodiment

Figure 4:
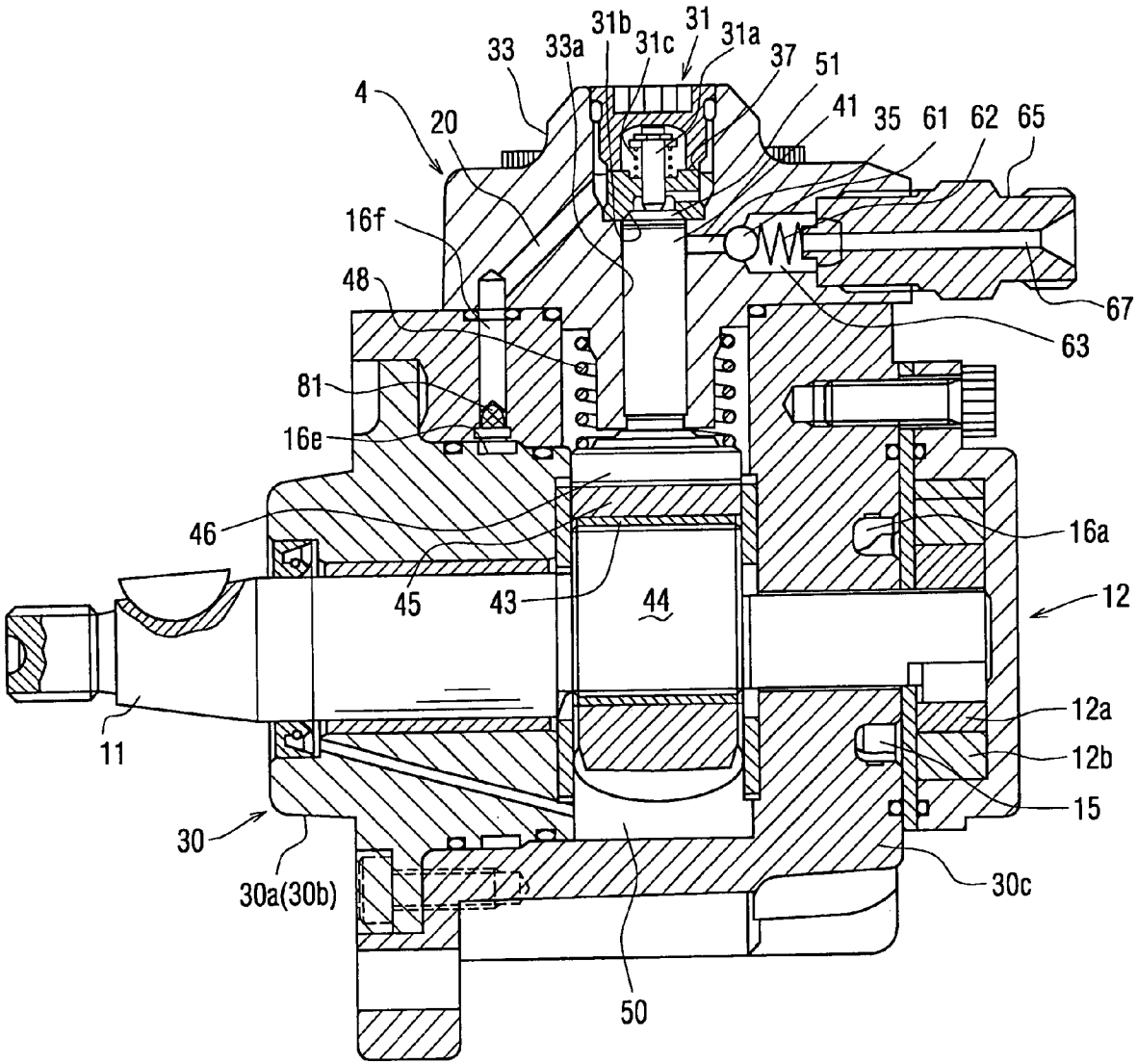
FIG. 4 is a longitudinal sectional view showing a fuel injection pump according to a third embodiment of the present invention.

In the third embodiment, the filter 81 is interposed between the bearing portion 30*b* and the main body portion 30*c*, which construct the first housing portion 30*a* so that the first housing portion 30*a* is made up of the separate components, as shown in FIG. 4. The first low-pressure fuel passage, the fuel suction passage and the fuel lubrication passage formed in the main body portion 30*c* are not shown in FIG. 4. The inlet 14 and the suction quantity control electromagnetic valve 5 are not shown in FIG. 4.

The fuel injection pump shown in FIG. 4 has three plungers 41, or three pump elements. The three plungers 41 are disposed around the camshaft 11 at an angular interval of 120° only one of the three plungers 41 is shown in FIG. 4.

The profile of the section of the cam ring 45 perpendicular to the axis is formed in the shape of a particular hexagon, which is made up of three straight lines and three arcs. More specifically, the outer peripheral surface of the cam ring 45 is made up of three flat surfaces and three curved surfaces. The three plungers 41 are pressed against the three flat surfaces of the cam ring 45 by the coil springs 48 through the plate members 46 respectively.

As shown in FIG. 4, the main body portion 30*c* is formed with a control fuel passage 16*f* and a first fuel passage portion (a first low-pressure fuel passage portion) of the first low-pressure fuel passage communicating with the second low-pressure fuel passage (the fuel suction passage) 20. The control fuel passage 16*f* has an opening facing a groove 16*e* of the bearing portion 30*b* and the other opening facing the inlet portion of the second low-pressure fuel passage 20. The first fuel passage portion leads from the feed pump 12 to the groove 16*e*. The groove 16*e* is a part of the first fuel passage portion.

The groove 16*e* is formed on the outer periphery of the bearing portion 30*b* so that the groove 16*e* extends circumferentially and the control fuel passages 16*f* corresponding to the three plungers 41 are connected to the groove 16*e*.

The filter 81 is disposed in one of both openings of the control fuel passage 16*f* formed in the main body portion 30*c*. In FIG. 4, the filter 81 is disposed in the opening of the control fuel passage 16*f* facing the groove 16*e*.

Thus, the filter 81 is disposed in the opening portion, or the outlet portion, of the control fuel passage 16*f* formed in the first housing 30*a* (more specifically, the main body portion 30*c*) like the first embodiment. Therefore, an effect similar to the effect of the first embodiment can be obtained.

In the present embodiment, the filter 81 may be disposed in the opening portion (the outlet portion) of the control fuel passage 16*f* on the side communicating with the second low-pressure fuel passage (the fuel suction passage) 20.

Fourth Embodiment

Next, a fuel injection pump (a supply pump) according to a fourth embodiment of the present invention will be explained based on FIGS. 5A and 5B.

Figure 5A:
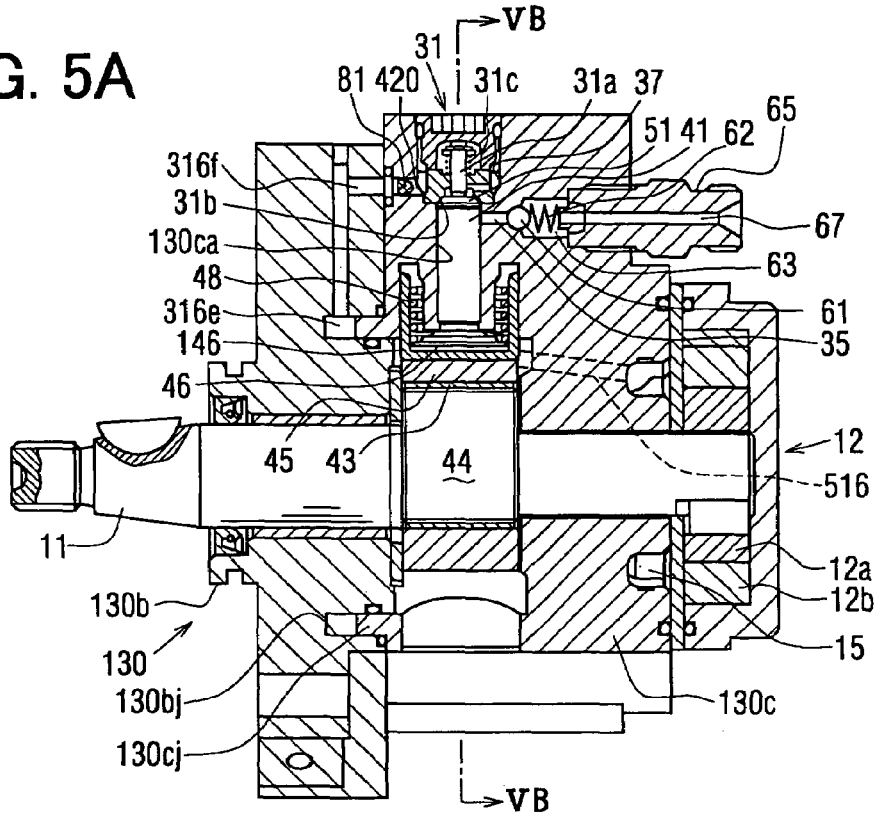
FIG. 5A is a longitudinal sectional view showing a fuel injection pump according to a fourth embodiment of the present invention.

In the fuel injection pump shown in FIG. 5A, a housing main body portion 130*c* of a housing 130 houses the plungers 41 so that the plungers 41 can reciprocate and houses the eccentric cam 44 and the cam ring 45 so that the eccentric cam 44 and the cam ring 45 can rotate.

As shown in FIG. 5A, the housing 130 includes a bearing portion 130*b* and the housing main body portion 130*c*. The bearing portion 130*b* rotatably houses one of both ends (the left end in FIG. 5A) of the camshaft 11. The housing main body portion 130*c* rotatably houses the eccentric cam 44 and the cam ring 45 in the cam chamber 50. Meanwhile, the housing main body portion 130*c* houses the plunger 41 in a sliding hole 130*ca* so that the plunger 41 can reciprocate in a vertical direction in FIG. 5A. The fuel pressurizing chamber 51 is provided by an inner peripheral surface of the sliding hole 130*ca* and the suction valve 31 (more specifically, the valve member 31*a*) on the upper end surface of the plunger 41 in FIG. 5A. As shown in FIG. 5A, the suction valve 31 and the discharge valve 61 communicating with the fuel pressurizing chamber 51 through the fuel pressure-feeding passage 35 are disposed in the housing main body portion 130*c*. The housing main body portion 130*c* is formed with a fuel suction passage 420, which communicates with the suction valve 31.

As shown in FIG. 5A, the bearing portion 130*b* is formed with a concave stepped portion 130*bj* and the housing main body portion 130*c* is formed with a convex stepped portion 130*cj*. The convex stepped portion 130*cj* can be inserted into the concave stepped portion 130*bj*. The concave stepped portion 130*bj* and the convex stepped portion 130*cj* are formed substantially in the shape of rings and provide a ring-shaped fuel passage 316*e* extending circumferentially. The bearing portion 130*b* is formed with a control fuel passage 316*f* for connecting the ring-shaped fuel passage 316*e* with the fuel suction passage 420. The fuel flows from the discharge portion of the feed pump 12 to the ring-shaped fuel passage 316*e* through a fifth low-pressure fuel passage 516.

The ring-shaped fuel passage 316*e* and the control fuel passage 316*f* provide a third low-pressure fuel passage in the bearing portion 130*b* for streaming the low-pressure fuel. The outlet portion of the third low-pressure fuel passage 316*e*, 316*f* of the bearing portion 130*b* on the fuel pressurizing chamber 51 side faces the inlet portion of the fuel suction passage 420. The low-pressure fuel is introduced from the outlet portion of the third low-pressure fuel passage 316*e*, 316*f* to the inlet portion of the fuel suction passage 420.

The fuel suction passage 420 is formed in the housing main body portion 130*c* and provides a fourth low-pressure fuel passage leading toward the pressurizing chamber 51.

In the present embodiment, the filter 81 is disposed in the inlet portion of the fourth low-pressure fuel passage (the fuel suction passage) 420 as shown in FIG. 5A.

Figure 5B:
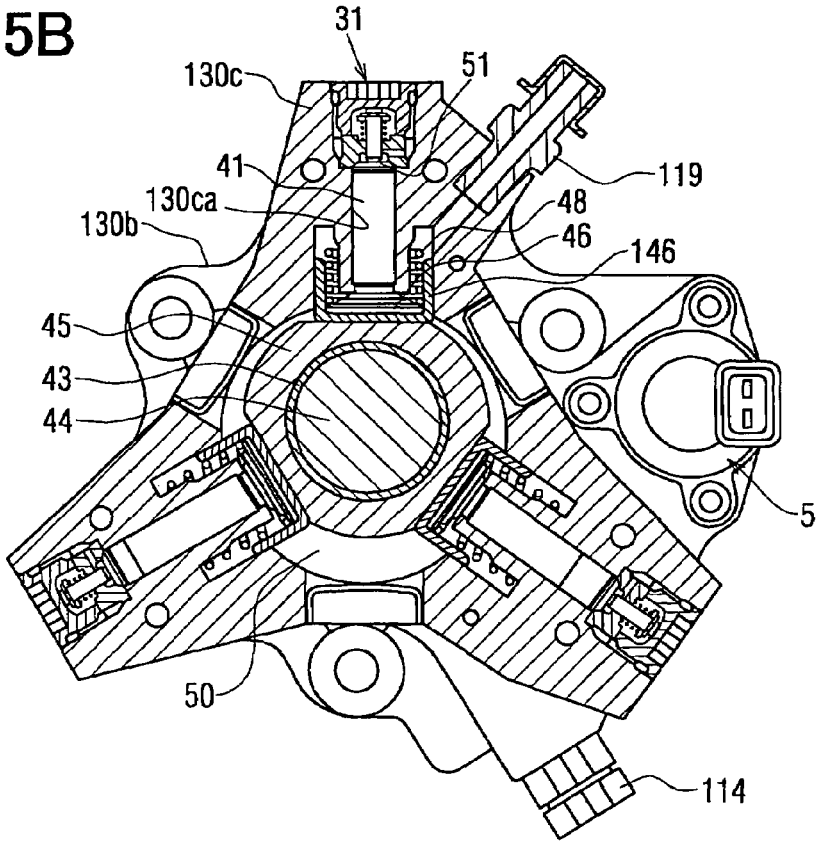
FIG. 5B is a sectional view showing the fuel injection pump of FIG. 5A taken along the line VB-VB.

As shown in FIG. 5B, an inlet 114 and the suction quantity control electromagnetic valve 5 may be disposed in the bearing portion 130*b*. An outlet 119 may be disposed in the housing main body portion 130*c*.

As shown in FIGS. 5A and 5B, a cylindrical cup member 146 with a bottom is interposed between the plate member 46 and the cam ring 45. Alternatively, the cup member 146 may not be interposed between the plate member 46 and the cam ring 45.

In the present embodiment, the housing 130 includes the bearing portion 130*b*, which rotatably houses the camshaft 11, and the housing main body portion 130*c*, which is coupled with the bearing portion 130*b* through insertion. The housing main body portion 130*c* is an integral-type housing for housing the eccentric cam 44 and the cam ring 45 so that the eccentric cam 44 and the cam ring 45 can rotate and for housing the plunger 41 so that the plunger 41 can reciprocate. Even though the housing main body portion 130*c* is the integral-type housing, the filter 81 is disposed in the inlet portion of the fourth low-pressure fuel passage 420 of the housing main body portion 130*c*. Therefore, even if the extraneous matters remain in the low-pressure fuel passage of the housing 130 because of the insufficient cleaning in the high-pressure cleaning, the extraneous matters, which can enter the fuel pressurizing chamber 51, are trapped with the filter 81.

In the present embodiment, the housing main body portion 130*c* is formed with the fifth low-pressure fuel passage 516 for streaming the low-pressure fuel from the feed pump 12 toward the fuel pressurizing chamber 51. The outlet portion of the fifth low-pressure fuel passage 516 on the fuel pressurizing side should be preferably connected to the third low-pressure fuel passage 316*e*, 316*f* (the ring-shaped fuel passage 316*e*, in the present embodiment). Thus, the low-pressure fuel passage can have a firm structure, compared to the case where the discharge portion of the low-pressure fuel of the feed pump 12 in the housing main body portion 130*c* is connected with the third low-pressure fuel passage 316*e*, 316*f* in the bearing portion 130*b* through an exterior pipe and the like. Accordingly, the reliability of the low-pressure fuel passage for streaming the low-pressure fuel can be improved.

The filter 81 may be disposed in a fuel passage leading from the inlet portion of the fourth low-pressure fuel passage 420 to the fuel pressurizing chamber 51 in the fourth low-pressure fuel passage 420, instead of disposing the filter 81 in the inlet portion of the fourth low-pressure fuel passage 420. Thus, even if the extraneous matters remain in the low-pressure fuel passage of the housing 130 because of the insufficient cleaning in the high-pressure cleaning, the extraneous matters, which can enter the fuel pressurizing chamber 51, are eliminated.

The filter 81 should be preferably disposed in a fuel passage leading from the inlet portion of the fourth low-pressure fuel passage 420 to the suction valve 31 in the fourth low-pressure fuel passage 420. Thus, the filter 81 is disposed upstream of the suction valve 31 with respect to the flow of the fuel. Accordingly, even if the extraneous matters remain in the low-pressure fuel passage of the housing 130, the extraneous matters, which can enter the suction valve 31 and the fuel pressurizing chamber 51, are eliminated. Thus, the troubles, which are caused by the extraneous matters and can degrade the performance and the reliability of the suction valve 31 and the fuel pressurizing chamber 51, can be prevented.

Fifth Embodiment

Next, a fuel injection pump (a supply pump) according to a fifth embodiment of the present invention will be explained based on FIG. 6.

Figure 6:
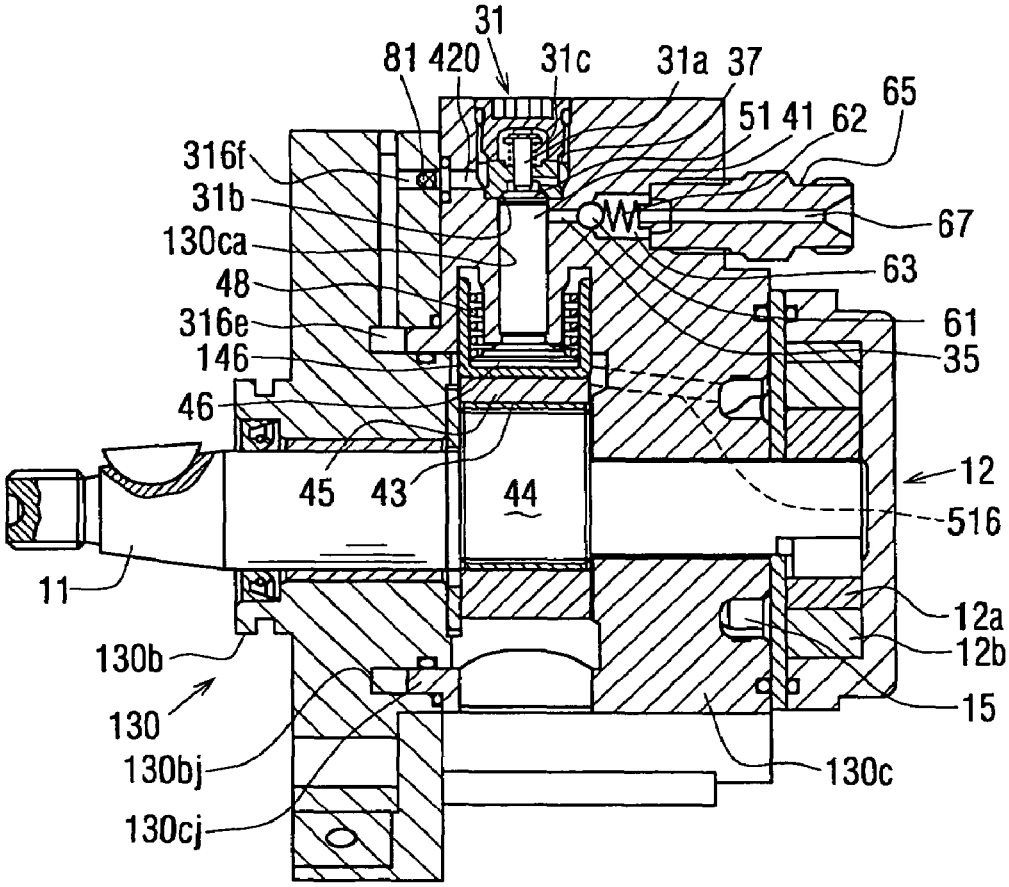
FIG. 6 is a longitudinal sectional view showing a fuel injection pump according to a fifth embodiment of the present invention.

In the fifth embodiment, the filter 81 is disposed in the outlet portion of the third low-pressure fuel passage 316*e*, 316*f* of the bearing portion 130*b* on the fuel pressurizing chamber 51 side as shown in FIG. 6, instead of disposing the filter 81 in the inlet portion of the fourth low-pressure fuel passage 420 in the housing main body portion 130*c*.

Even in the case where the filter 81 is disposed in the outlet portion of the third low-pressure fuel passage 316*e*, 316*f* of the bearing portion 130*b* on the fuel pressurizing chamber 51 side, an effect similar to that of the fourth embodiment can be obtained.

MODIFICATION

Figure 7A:
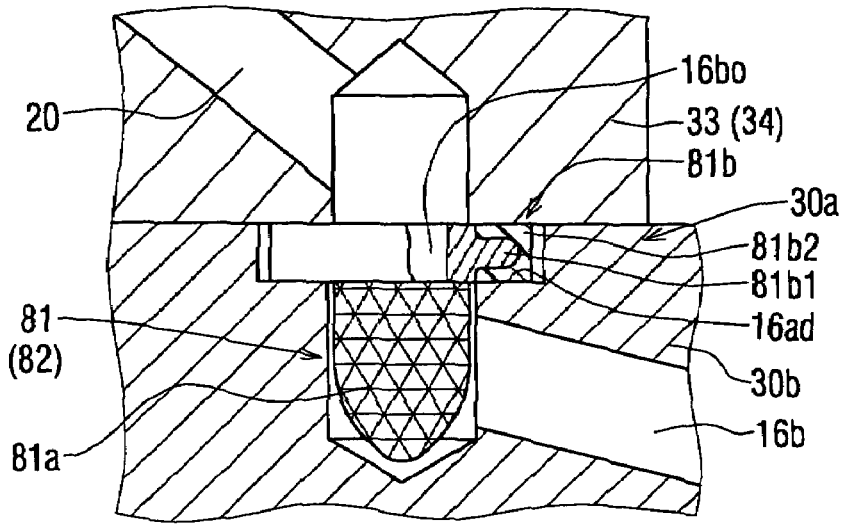
FIG. 7A is an enlarged fragmentary sectional view showing a filter incorporated in a fuel injection pump of a modified example of the present invention.

In the above embodiments, each one of the filters 81, 82 is fitted to the fitting hole 83 formed in the opening portion of the low-pressure fuel passage. Alternatively, as shown in FIG. 7A, the guide portion 81*b* of the filter 81 may be made up of a holding member 81*b*1 for holding the metallic mesh portion 81*a* and a sealing portion 81*b*2 such as a rubber member coated on the upper and lower end surfaces of the holding member 81*b*1. More specifically, as shown in FIG. 7A, the holding member 81*b*1 has a flange portion extending outward from the substantial center of the outer periphery. The sealing portion 81*b*2 is formed on the flange portion through burning, insert molding or the like. The thickness of the sealing portion 81*b*2 is set so that the fluid-tightness between the second housing portions 33, 34 and the first housing portion 30*a* is maintained when the filter 81 is disposed on the stepped portion 16*ad*. Also in the above structure, an effect similar to the effect of the above embodiments can be obtained. Moreover, since the filter 81 has a function of maintaining the fluid-tightness between the second housing portions 33, 34 and the first housing portion 30*a*, the sealing member 91 is unnecessary. Thus, the number of the parts can be reduced. The metallic mesh portion 81*a* may be formed substantially in the shape of a cylinder as shown in FIG. 7A, instead of the substantially conical shape.

Figure 7B:
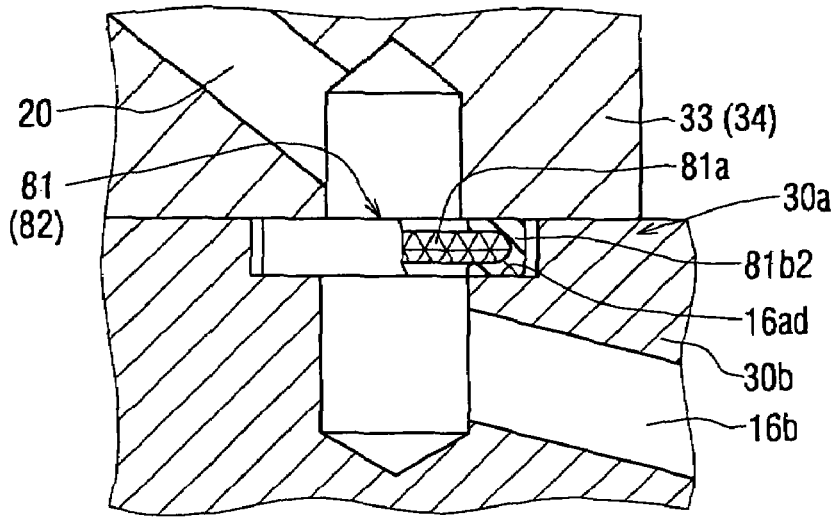
FIG. 7B is an enlarged fragmentary sectional view showing a filter incorporated in the fuel injection pump of the modified example of the present invention.

Alternatively, the metallic mesh portion 81*a* may be formed in the shape of a flat plate as shown in FIG. 7B. The sealing portion 81*b*2 shown in FIG. 7B may be coated on the metallic mesh portion 81, or the metallic mesh portion 81 and a sealing member 91 may be disposed separately.

The metallic mesh portion 81*a* may be formed of a stainless-steel metallic mesh, or may be formed of porous ceramic material.

The fuel injection pump according to the first or second embodiment includes the two plungers, and the fuel injection pump according to the third, fourth or fifth embodiment includes the three plungers. A similar effect can be obtained by applying the present invention to any type of fuel injection pump having multiple plungers.

In the above embodiments, the present invention is applied to the supply pump of the common rail type fuel injection system. Alternatively, the present invention can be applied to any type of fuel injection pump if the fuel injection pump has a structure for performing the pressurization of the fuel drawn from the fuel tank, the introduction of the low-pressure fuel (at a pressure between the fuel pressure in the fuel tank and the fuel injection pressure) into the fuel pressurizing chamber, the pressurization of the low-pressure fuel in the fuel pressurizing chamber through the movement of the plunger, and the discharge of the high-pressure fuel (at the fuel pressure corresponding to the fuel injection pressure) through the movement of the plunger.

The present invention should not be limited to the disclosed embodiments, but may be implemented in many other ways without departing from the spirit of the invention.

What is claimed is:

1. A fuel injection pump comprising:

a camshaft driven by an internal combustion engine to rotate;

a cam rotating with the camshaft;

a cam ring revolving around the camshaft so that the cam ring rotates with respect to the cam along an outer periphery of the cam;

a housing for rotatably housing the camshaft, the housing being formed with a fuel pressurizing chamber;

a plunger, which reciprocates in accordance with the revolution of the cam ring to pressurize and pressure-feed fuel drawn into the fuel pressurizing chamber; and a rotary pump rotated by the camshaft for supplying the fuel, which is drawn into the fuel pressurizing chamber, wherein the housing includes a first housing portion for rotatably housing the camshaft, the cam ring and the rotary pump, and a second housing portion for housing the plunger so that the plunger can reciprocate, the first housing portion is formed with a first low-pressure fuel passage for streaming low-pressure fuel from the rotary pump toward the fuel pressurizing chamber, the second housing portion is formed with a second low-pressure fuel passage connected to the fuel pressurizing chamber, and the fuel injection pump further comprises a filter disposed downstream of the rotary pump in one of an outlet portion of the first low-pressure fuel passage, an inlet portion of the second low-pressure fuel passage facing the outlet portion of the first low-pressure fuel passage, and a certain point in the second low-pressure fuel passage.

2. The fuel injection pump as in claim 1, further comprising a check valve disposed in the second low-pressure fuel passage of the second housing portion between the certain point and the fuel pressurizing chamber so that a forward direction of the check valve coincides with a flow direction of the low-pressure fuel flowing toward the fuel pressurizing chamber.

3. The fuel injection pump as in claim 2, further comprising a control valve disposed in the first low-pressure fuel passage of the first housing portion for controlling a quantity of the fuel passing through the check valve.

4. The fuel injection pump as in claim 1, wherein the first housing portion includes a bearing portion for rotatably housing one of both ends of the camshaft, and a main body portion fitted to the bearing portion, the bearing portion is formed with a groove circumferentially on its outer periphery, and the main body portion is formed with a first fuel passage portion for streaming the low-pressure fuel to the groove toward the fuel pressurizing chamber, and with a second fuel passage portion for streaming the low-pressure fuel from the groove toward the second low-pressure fuel passage, the first and second fuel passage portions constituting at least a part of the first low-pressure fuel passage.

5. The fuel injection pump as in claim 1, further comprising a discharge valve disposed between the fuel pressurizing chamber and a common rail for streaming high-pressure fuel to the common rail if a fuel pressure in the fuel pressurizing chamber exceeds a fuel pressure in the common rail, the common rail accumulating the fuel, which is pressurized in the fuel pressurizing chamber through the movement of the plunger and is pressure-fed through the movement of the plunger, at a high pressure.

6. A fuel injection pump comprising:

a camshaft driven by an internal combustion engine to rotate;

a cam rotating with the camshaft;

a cam ring revolving around the camshaft so that the cam ring rotates with respect to the cam along an outer periphery of the cam;

a housing for rotatably housing the camshaft, the housing being formed with a fuel pressurizing chamber; and a plunger, which reciprocates in accordance with the revolution of the cam ring to pressurize and pressure-feed fuel drawn into the fuel pressurizing chamber, wherein the housing includes a first housing portion for rotatably housing the camshaft and the cam ring, and a second housing portion for housing the plunger so that the plunger can reciprocate, the first housing portion is formed with a first low-pressure fuel passage for streaming low-pressure fuel toward the fuel pressurizing chamber and has a control valve disposed in the first low-pressure fuel passage of the first housing portion, the second housing portion is formed with a second low-pressure fuel passage connected to the fuel pressurizing chamber, and the fuel injection pump further comprises a filter disposed downstream of the control valve in one of an outlet portion of the first low-pressure fuel passage, an inlet portion of the second low-pressure fuel passage facing the outlet portion of the first low-pressure fuel passage, and a certain point in the second low-pressure fuel passage.

7. The fuel injection pump as in claim 6, further comprising a check valve disposed in the second low-pressure fuel passage of the second housing portion between the certain point and the fuel pressurizing chamber so that a forward direction of the check valve coincides with a flow direction of the low-pressure fuel flowing toward the fuel pressurizing chamber.

8. The fuel injection pump as in claim 7, wherein the control valve controls a quantity of the fuel passing through the check valve.

9. The fuel injection pump as in claim 6, wherein the first housing portion includes a bearing portion for rotatably housing one of both ends of the camshaft, and a main body portion fitted to the bearing portion, the bearing portion is formed with a groove circumferentially on its outer periphery, and the main body portion is formed with a first fuel passage portion for streaming the low-pressure fuel to the groove toward the fuel pressurizing chamber, and with a second fuel passage portion for streaming the low-pressure fuel from the groove toward the second low-pressure fuel passage, the first and second fuel passage portions constituting at least a part of the first low-pressure fuel passage.

10. The fuel injection pump as in claim 6, further comprising a discharge valve disposed between the fuel pressurizing chamber and a common rail for streaming high-pressure fuel to the common rail if a fuel pressure in the fuel pressurizing chamber exceeds a fuel pressure in the common rail, the common rail accumulating the fuel, which is pressurized in the fuel pressurizing chamber through the movement of the plunger and is pressure-fed through the movement of the plunger, at a high pressure.

11. A fuel injection pump comprising:

a camshaft driven by an internal combustion engine to rotate;

a cam rotating with the camshaft;

a cam ring revolving around the camshaft so that the cam ring rotates with respect to the cam along an outer periphery of the cam;

a housing for rotatably housing the camshaft, the housing being formed with a fuel pressurizing chamber; and a plunger, which reciprocates in accordance with the revolution of the cam ring to pressurize and pressure-feed fuel drawn into the fuel pressurizing chamber, wherein the housing includes a bearing portion for rotatably housing one of both ends of the camshaft, and a housing main body portion, which houses the bearing portion so that the bearing portion is coupled with the housing main body portion through insertion, the cam so that the cam can rotate, the cam ring so that the cam ring can rotate, and the plunger so that the plunger can reciprocate, the bearing portion is formed with a third low-pressure fuel passage for streaming low-pressure fuel toward the fuel pressurizing chamber, the housing main body portion is formed with a fourth low-pressure fuel passage connected to the fuel pressurizing chamber, and the fuel injection pump further comprises a filter disposed in one of an outlet portion of the third low-pressure fuel passage on a fuel pressurizing chamber side, an inlet portion of the fourth low-pressure fuel passage facing the outlet portion of the third low-pressure fuel passage, and a certain point in the fourth low-pressure fuel passage.

12. The fuel injection pump as in claim 11, further comprising a check valve disposed in the fourth low-pressure fuel passage of the housing main body portion between the certain point and the fuel pressurizing chamber so that a forward direction of the check valve coincides with a flow direction of the low-pressure fuel flowing toward the fuel pressurizing chamber.

13. The fuel injection pump as in claim 11, further comprising:

a rotary pump rotated by the camshaft for supplying the fuel, which is drawn into the fuel pressurizing chamber, wherein the housing main body portion is formed with a fifth low-pressure fuel passage for streaming the low-pressure fuel from the rotary pump toward the fuel pressurizing chamber, and the third low-pressure fuel passage is connected with an outlet portion of the fifth low-pressure fuel passage on the fuel pressurizing chamber side.

14. The fuel injection pump as in claim 11, further comprising a discharge valve disposed between the fuel pressurizing chamber and a common rail for streaming high-pressure fuel to the common rail if a fuel pressure in the fuel pressurizing chamber exceeds a fuel pressure in the common rail, the common rail accumulating the fuel, which is pressurized in the fuel pressurizing chamber through the movement of the plunger and is pressure-fed through the movement of the plunger, at a high pressure.

15. A fuel injection pump comprising:

a camshaft driven by an internal combustion engine to rotate;

a cam rotating with the camshaft;

a cam ring revolving around the camshaft so that the cam ring rotates with respect to the cam along an outer periphery of the cam;

a housing for rotatably housing the camshaft, the housing being formed with a fuel pressurizing chamber; and a plunger, which reciprocates in accordance with the revolution of the cam ring to pressurize and pressure-feed fuel drawn into the fuel pressurizing chamber, wherein the housing has a first filter at a suction portion, which introduces the fuel from an outside, and a sliding component upstream of the fuel pressurizing chamber and is formed with a fuel passage leading from the first filter to a discharge portion, which discharges the fuel, through the fuel pressurizing chamber, and the fuel injection pump further comprises a second filter disposed downstream of the sliding component and upstream of the fuel pressurizing chamber in the fuel passage formed in the housing.

16. The fuel injection pump as in claim 15, wherein the sliding member is a rotary pump disposed downstream of the first filter for supplying the fuel, which is drawn into the fuel pressurizing chamber, when rotated by the camshaft, and wherein the second filter is disposed in a certain point in a fuel passage portion leading from the rotary pump to the discharge portion through the fuel pressurizing chamber in the fuel passage.

17. The fuel injection pump as in claim 15, further comprising a discharge valve disposed between the fuel pressurizing chamber and a common rail for streaming high-pressure fuel to the common rail if a fuel pressure in the fuel pressurizing chamber exceeds a fuel pressure in the common rail, the common rail accumulating the fuel, which is pressurized in the fuel pressurizing chamber through the movement of the plunger and is pressure-fed through the movement of the plunger, at a high pressure.

18. The fuel injection pump as in claim 1, wherein the filter is disposed at an opening of the first or second low-pressure fuel passage opening in a surface of the first or second housing portions, at which the first and second housing portions abut on each other.

19. The fuel injection pump as in claim 6, wherein the filter is disposed at an opening of the first or second low-pressure fuel passage opening in a surface of the first or second housing portions, at which the first and second housing portions abut on each other.

20. The fuel injection pump as in claim 15, wherein the housing has at least two housing portions, and the second filter is disposed at an opening of the fuel passage opening in a surface of one of the housing portions, at which the housing portions abut on each other.

* * * * *